US009157200B2

(12) United States Patent
Lumsden et al.

(10) Patent No.: US 9,157,200 B2
(45) **Date of Patent: *Oct. 13, 2015**

(54) VEHICLE BARRIER SYSTEM WITH ILLUMINATING GATE ARM AND METHOD

(71) Applicant: GateArm Technologies, Inc., Port St. Lucie, FL (US)

(72) Inventors: Russel Lumsden, Port St. Lucie, FL (US); Jaikeeshan Sirju, North Lauderdale, FL (US); Bryce Charles Fortney, Stuart, FL (US)

(73) Assignee: GateArm Technologies,Inc., Port Saint Lucie, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/470,134

(22) Filed: Aug. 27, 2014

(65) Prior Publication Data

US 2014/0363229 A1 Dec. 11, 2014

Related U.S. Application Data

(63) Continuation of application No. 13/803,093, filed on Mar. 14, 2013, now Pat. No. 8,845,125.

(60) Provisional application No. 61/654,280, filed on Jun. 1, 2012.

(51) Int. Cl.
*E01F 13/06* (2006.01)
*B61L 29/04* (2006.01)
(Continued)

(52) U.S. Cl.
CPC ..... *E01F 13/06* (2013.01); *B61L 29/04* (2013.01); *B61L 29/24* (2013.01); *F21S 4/003* (2013.01); *F21Y 2103/003* (2013.01)

(58) Field of Classification Search
CPC ..... F21S 8/00; F21V 33/00
USPC ..... 362/152, 84, 249.02, 145; 340/908
See application file for complete search history.

(56) References Cited

U.S. PATENT DOCUMENTS 1,211,676 A 1/1917 Coleman
4,666,108 A 5/1987 Fox
(Continued)

FOREIGN PATENT DOCUMENTS

DE 102008016070 A1 10/2009
EP 2105534 9/2009
(Continued)

OTHER PUBLICATIONS

Amano McGann Parking Solutions, "APG-1700 Series Parking Gate", Company Brochure Spec Sheet, Retrieved from Internet Oct. 28, 2014, http://www.amanomcgann.com, (2011).
(Continued)

*Primary Examiner* — Anabel Ton
(74) *Attorney, Agent, or Firm* — McHale & Slavin, P.A.

(57) ABSTRACT

The present invention is directed to a vehicle barrier system and method of use. The vehicle barrier system includes a control system adapted to pivot a gate arm between a horizontal position and a vertical position to control the flow of vehicle or pedestrian traffic in control access areas such as parking lots, or parking garages. The gate arm includes inset channels that are disposed along the longitudinal axis of the gate arm and configured to each remove ably receive an array of light emitting diodes to increase visibility and alert drivers or pedestrians to the presence of a gate arm.

10 Claims, 4 Drawing Sheets

(51) Int. Cl.

| | |
|---|---|
| ***F21S 4/00*** | (2006.01) |
| ***B61L 29/24*** | (2006.01) |
| *F21Y 103/00* | (2006.01) |

(56) References Cited

U.S. PATENT DOCUMENTS

| | | | | |
|---|---|---|---|---|
| 4,811,516 | A | 3/1989 | Anderson | |
| 6,472,823 | B2 | 10/2002 | Yen | |
| 6,487,818 | B1 * | 12/2002 | Hamann et al. | 49/49 |
| 6,691,467 | B2 | 2/2004 | Hincher, Sr. | |
| 6,860,007 | B1 | 3/2005 | Liu et al. | |
| 6,997,417 | B2 * | 2/2006 | Zarkades | 246/125 |
| 7,258,461 | B1 | 8/2007 | Izardel | |
| 7,258,467 | B2 | 8/2007 | Saccomanno et al. | |
| 7,818,920 | B2 | 10/2010 | Causey et al. | |
| 8,011,797 | B2 | 9/2011 | Rihl | |
| 8,231,247 | B2 | 7/2012 | Olmsted | |
| 8,845,125 | B1 * | 9/2014 | Lumsden et al. | 362/152 |
| 2007/0199243 | A1 * | 8/2007 | Youn | 49/49 |
| 2008/0038055 | A1 | 2/2008 | Jankovsky | |
| 2008/0136661 | A1 * | 6/2008 | Pederson et al. | 340/815.45 |
| 2008/0240854 | A1 | 10/2008 | Binns | |

FOREIGN PATENT DOCUMENTS

| | | |
|---|---|---|
| EP | 2527536 | 11/2012 |
| KR | 10200887282 | 6/2007 |

OTHER PUBLICATIONS

Amano Cincinnati AGP-1700 Parking Gate, Tsci, Spec Sheet, Retrieved from Internet Oct. 28, 2014, http://www.amanomcgann.com, (Nov. 22, 2011).

Amano Parking Gates, "AGP-1700 Series Parking Barriers", Product Sheet, retrieved from Internet Oct. 28, 2014, http://www.amanomcgann.com/product/display/85?categoryid=137, (2012).

Reexamination Office Action, 90/013,402, Apr. 21, 2015.

Response to Office Action ExParte Reexamination, 90/013,402, Apr. 21, 2015.

Supplemental Response to Office Action Ex Parte Reexamination, 90/013,402, Aug. 4, 2015.

*Gatearm Technologies, Inc.* v. *Access Masters, LLC.*, and *Blacksky Technologies, Inc.*, Case No. 0:14-cv-62697-RNS (S.D.FL.).

* cited by examiner

VEHICLE BARRIER SYSTEM WITH ILLUMINATING GATE ARM AND METHOD

CROSS-REFERENCE TO RELATED APPLICATION

In accordance with 37 C.F.R. §1.76, a claim of priority is included in an Application Data Sheet filed concurrently herewith. Accordingly, the present invention claims priority as a continuation of U.S. patent application Ser. No. 13/803,093, filed Mar. 14, 2013, entitled VEHICLE BARRIER SYSTEM WITH ILLUMINATING GATE ARM AND METHOD, which claims priority of U.S. Provisional Patent Application No. 61/654,280, filed on Jun. 1, 2012. The contents of which the above referenced applications are incorporated hereby by reference in their entirety.

FIELD OF THE INVENTION

The present invention relates generally to barrier systems. More particularly, the present disclosure relates to a vehicle barrier system and method where the barrier system includes a control system adapted to pivot a gate arm between a guarded and unguarded position to provide controlled access of vehicle traffic in restricted areas such as parking lots, parking garages, or other controlled access areas. The gate arm includes a plurality of light emitting diodes that are removeably inserted in channels formed along the length the gate arm to increase visibility and alert drivers or pedestrians to the presence of a vehicle barrier.

BACKGROUND OF THE INVENTION

There are a number of physical barriers that are often used in regulating the flow of pedestrian traffic in designated areas. Exemplary types of physical barriers include erectable signs, banners, vertical cones, and gates. Such barriers have typically been developed to restrict individuals from entering or exiting controlled access areas, to provide warnings, or to identify passageways or direction to individuals. Many of these physical barriers are often used in banks, shopping centers, movie theaters, government buildings, and other public forums.

Traffic or vehicle barriers have also been developed to provide controlled access of vehicle traffic to restricted areas such as parking lots, parking garages, loading docks, or to control the flow of traffic on roads and highways. Typical vehicle barriers often include plastic barrels, cones, colored poles, interlocking barriers filled with a ballast material such as water or sand to help stabilize the barriers, reinforced steel barriers, cement barriers, traffic safety barriers including a plank disposed between A frame legs, and barriers including a gate arm that is operatively pivoted in a horizontal and generally vertical position to provide passage of vehicle traffic. Many conventional vehicle barriers employ physical indicators, such as reflective tape, markers, or bright colors, to help increase visibility and effectively capture drivers' attention to better assist them in visually identifying vehicle barriers from a distance, and at night. However, many vehicle barriers including such physical indicators provide limited use. For example, most physical indicators are more effective during the day when a driver's visibility is less impaired as compared to at night. Also, driver's often cannot see the physical indicators from greater distances, and as such, by the time the driver is alerted to the presence of the barrier, the vehicle is within close proximity of the barrier thereby further impairing the driver's ability to respond effectively. The reflective tape, markers or bright colors, used on vehicle barriers, tend to fade over time, are often covered with debris, and provide limited visibility at night.

To address the limitations that vehicle barriers with physical indicators provide, many vehicle barriers have been developed to include an electronic light assembly. In use, most light assemblies are typically fastened to the outer surface of barriers using mounting flanges, brackets, screws, or bolts. The light assembly typically includes a large, round red or yellow lens body attached to a waterproof receptacle for housing circuitry and a power source such as batteries. One or more incandescent bulbs are generally connected to the power source, via a switching mechanism. Such light assemblies are often seen on vehicle barriers comprising barrels, and safety barriers where the light assembly is secured on top of a horizontal plank, or on top of the support frame. Vehicle barriers including electronic light assemblies are designed to alert drivers to the presence of vehicle barriers at night or in low lit areas.

However, conventional vehicle barriers employing electronic light assemblies have certain drawbacks. Many vehicle barriers use a single, light assembly that is mounted on the external surface of the vehicle barrier. The single light assembly often provides limited visibility to drivers at night. Further, maintenance of such light assemblies can be time consuming, burdensome and costly. Prior art light assemblies tend to be bulky, heavy and are typically mounted on the external surface of vehicle barriers using large brackets, or a number of blots thus increasing both the costs and time in attaching and removing the light assemblies for each vehicle barrier. Technicians are often forced to remove light assemblies from vehicle barriers to make necessary repairs as a result of traffic engaging the vehicle barriers and damaging the lighting devices. Also, general maintenance of the light assemblies can be time consuming, and often results in the need for placing the vehicle barriers out of commission for a period of time while making necessary repairs, or replacing parts.

SUMMARY OF THE INVENTION

The present invention overcomes the deficiencies of the known art and the problems that remain unsolved by providing a barrier system including a control system adapted to pivot a gate arm between a horizontal position and a vertical position to control the flow of vehicle or pedestrian traffic in control access areas such as parking lots, or parking garages. The gate arm includes inset channels for removeably receiving an array of light emitting diodes to increase visibility and alert drivers or pedestrians to the presence of a gate arm at night.

In accordance with one implementation of the present invention, there is provided a vehicle barrier system comprising:

a housing;

a gate arm coupled to the housing and including at least one elongated inset channel having an opening, said at least one elongated inset channel formed along a longitudinal axis of the gate arm; a control system enclosed in the housing and operatively coupled to the gate arm to selectively pivot the gate arm between a horizontal position and a vertical position; a mounting member attached to the housing for installing the housing adjacent a roadway of a controlled access area; at least one light strip including a plurality of light emitting diodes each electrically connected in parallel and physically disposed adjacent one another in series, and encased within a protective member and including a first electrical cable connected to said plurality of light emitting diodes; an electronic connector electrically connected to the first electrical cable, and releasably fastened to the gate arm;

a power supply enclosed within the housing and releasably, electrically connected to the electronic connector;

an electrical switch selectively operated to couple the power supply to the at least one light strip; and wherein the at least one light strip is removeably retained within the at least one elongated inset channel such that light from the plurality of light emitting diodes enumerates through the opening when the plurality of diodes are powered from said power supply.

In another aspect, the control system includes anyone of an electrically motorized system, a pneumatic system, a hydraulic system, or a spring-balanced system.

In another aspect, the at least one elongated inset channel includes a first elongated inset channel having a first opening, and a second elongated inset channel having a second opening, where the second elongated inset channel is disposed opposite the first elongated inset channel.

In another aspect, the gate arm includes a first pair of inset channel sidewalls integrally joined to a first inset channel backwall to form the first elongated inset channel, and a second pair of inset channel sidewalls integrally joined to a second inset channel backwall to form the second elongated inset channel, where the inset channel sidewalls and the inset channel backwalls extend along a longitudinal axis within the gate atm.

In another aspect, the at least one light strip comprises a second light strip including another plurality of light emitting diodes each electrically connected in parallel and physically disposed adjacent one another in series, and encased within a protective member, and also including a second electrical cable connected to the another plurality of light emitting diodes and to another electronic connector, the another electronic connector electrically coupled to the power supply.

In another aspect, the gate arm includes a top convex member having a first upper sidewall and a second upper sidewall, and a bottom convex member having a first lower sidewall coextensively aligned with the first upper sidewall, and a second lower sidewall wall coextensively aligned with the second upper sidewall, where the top convex member is attached to the bottom convex member via, the first and second pair of inset channel sidewalls, and the first and second inset channel backwalls.

In another aspect, the first upper sidewall and the first lower sidewall each terminate partially within the first opening for removeably securing the at least one light strip within the first elongated inset channel, and wherein the second upper sidewall and the second lower sidewall each terminate partially within the second opening for removeably securing the second light strip within the second elongated inset channel.

In another aspect, the vehicle barrier system further includes a top member comprising a semi-circular shape having one end terminating partially within the first opening, and another end terminating partially within the second opening, and a bottom member comprising a semi-circular shape having one end terminating partially within the first opening, and another end terminating partially within the second opening, where the top member and the bottom member are integrally joined together via, the first elongated inset channel and the second elongated inset channel forming a generally circular gate arm.

In another aspect, the second light strip is removeably retained within the second elongated inset channel aligning the plurality of light emitting diodes towards the second opening such that light from the plurality of light emitting diodes of the second light strip enumerates through the second opening when the plurality of diodes are powered from the power supply.

In another aspect, the protective member comprises anyone of a clear rubber material, a clear resin, a clear epoxy, a clear hardened gel, a clear vinyl, or a transparent protective enclosure.

In accordance with another implementation of the present invention, there is provided a barrier system providing controlled access to a designated area, said barrier system comprising:

a housing;

a control arm coupled to the housing and including a first channel having a first opening, and a second channel having a second opening, each channel formed along a longitudinal axis within the control arm and disposed opposite each other;

a control system enclosed in the housing and operatively coupled to the control arm to selectively pivot the control arm between a horizontal position and a vertical position;

a first light assembly including a plurality of light emitting diodes each electrically connected in parallel and physically disposed adjacent one another in series, and encased within a protective substrate and including a first electrical connector electrically coupled to the plurality of light emitting diodes;

a second light assembly including another plurality of light emitting diodes each electrically connected in parallel and physically disposed adjacent one another in series, and encased within a protective substrate and including a second electrical connector electrically coupled to the another plurality of light emitting diodes;

a power supply enclosed within the housing and releasably, electrically connected to the electrical connectors; an electrical switch selectively operated to couple the power supply to said light assemblies; and wherein the first light assembly is removeably retained within the first channel with the plurality of light emitting diodes aligned towards the first opening and the first electrical connector removeably fastened to the control arm, and wherein the second light assembly is remove ably retained within the second channel with the another plurality of light emitting diodes aligned towards the second opening and the second electrical connector removeably fastened to the control arm.

In one aspect, the control arm comprises a circular geometric shape including a top member comprising a semi-circular shape having one end terminating partially within the first opening, and another end terminating partially within the second opening, and a bottom member comprising a semi-circular shape having one end terminating partially within the first opening, and another end terminating partially within the second opening, where the top member and the bottom member are integrally joined together via, the first and second channel.

In another aspect, the barrier system further includes a mounting post attached to the housing and adapted for installing the barrier system adjacent a roadway of a controlled access area such that the control arm is pivoted in a horizontal position to prevent the passage of vehicles, and in a generally vertical position to allow the passage of vehicles through.

In another aspect, the barrier system further includes a first power supply cable electrically connected to the power supply and releasably connected to the first electrical connector, and a second power supply cable electrically connected to the power supply and releasably connected to the second electrical connector.

In another aspect, the control system includes an activation device operated to pivot the control arm between a horizontal position and a vertical position. The activation device includes anyone of an electrical switch, a motion sensor system, a vehicle detection system, or a ticket dispenser.

In accordance with yet another implementation of the present invention, there is provided a method of regulating traffic in a controlled access area, said method comprising the steps of:

constructing a barrier system comprising:

a housing;

a gate coupled to the housing and including a first channel having a first opening, and a second channel having a second opening, each channel formed along a longitudinal axis within the gate and disposed opposite each other;

a control system operatively coupled to the gate and including an activation device to selectively pivot the gate between a horizontal position and a vertical position;

a first light assembly including a plurality of light emitting diodes each electrically connected in parallel and physically disposed adjacent one another in series, and encased within a protective enclosure and including a first electrical connector coupled to the plurality of light emitting diodes;

a second light assembly including another plurality of light emitting diodes each electrically connected in parallel and physically disposed adjacent one another in series, and encased within a protective enclosure and including a second electrical connector coupled to the another plurality of light emitting diodes;

a power supply enclosed within the housing and releasably, electrically connected to the electrical connectors; an electrical switch selectively operated to couple the power supply to the light assemblies; and wherein the first light assembly is removeably retained within the first channel with the plurality of light emitting diodes aligned towards the first opening and the first electrical connector removeably fastened to the gate, and wherein the second light assembly is removeably retained within the second channel with the another plurality of light emitting diodes aligned towards the second opening and the second electrical connector removeably fastened to the gate;

installing the housing and gate near a roadway of a controlled access area;

electrically connecting the power supply to a power source;

activating the electrical switch to power the first and second light assembly; and operating the activation device to pivot the gate between a horizontal position and a vertical position to selectively control the flow of traffic in the controlled access area.

In one aspect, the step of installing the housing and the gate near a roadway includes the step of attaching the housing to a mounting post and installing the mounting post adjacent said roadway.

In another aspect, the step of operating the control system to pivot the gate includes the step of detecting the presence of a vehicle or individual when situated near the gate a predetermined distance, and generating a signal to operate the control system.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed to a vehicle barrier system 10 for use in providing controlled access of vehicle traffic in particular designated areas including, but not limited to, parking lots, parking garages, loading docks, highways, military bases, airports, roadways, or the like. It will be understood that the barrier system 10 of the present invention may be modified slightly to provide a barrier system for use in providing controlled access of individuals or pedestrian traffic in or out of various designated areas including but not limited to, buildings, walkways, bridges, tunnels, or other areas where controlled access to individuals is contemplated.

Figure 1:
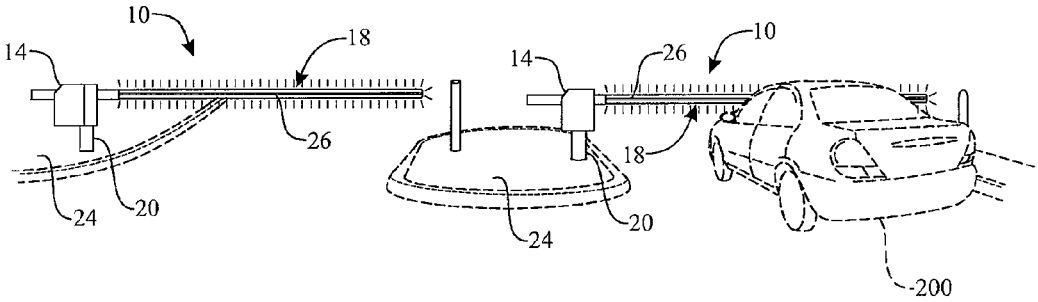
FIG. 1 presents a perspective view of vehicle barrier systems each installed adjacent a designated roadway and including a control system coupled to a gate arm, with the gate arm including a light assembly for visually alerting drivers or pedestrians to the presence of a vehicle barrier, in accordance with one embodiment of the present invention.
Figure 2:
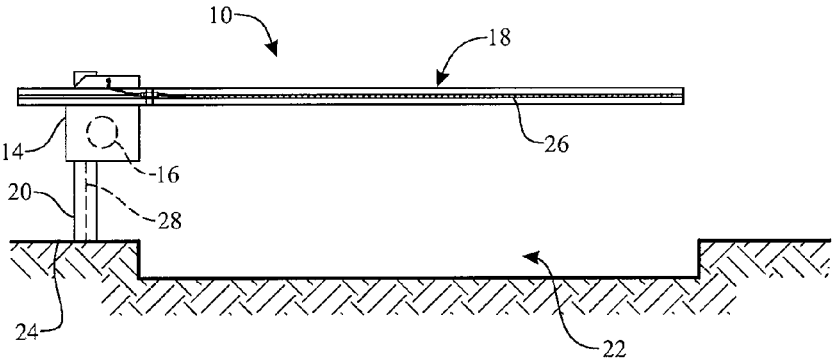
FIG. 2 presents a front view of the vehicle barrier system of FIG. 1, illustrating the light assembly that includes an array of light emitting diodes secured along the length of the gate arm with the gate arm displaced in a horizontal position for restricting vehicle passage, in accordance with one embodiment of the present invention.

With reference made to FIGS. 1 and 2, vehicle barrier systems 10 are each deployed along a designated roadway to provide controlled access of vehicles 200 in restricted areas that include parking lots, parking garages, military bases, government buildings or the like. It is noted that, for illustrative purposes, the functional elements, components and features of each vehicle barrier 10 are the same and thus identical vehicle barriers 10 are shown to provide controlled access through entrance and/or exit areas of a controlled access area. Vehicle barrier 10 includes a waterproof housing 14, for enclosing a control system 16 that is adapted to pivot a gate arm 18 between a guarded position and unguarded position thereby limiting the passage of vehicles 200 to enter or exit certain areas where controlled access of vehicle traffic is desired. Accordingly, control system 16 is adapted to pivot gate arm 18 in a horizontal, guarded position such that vehicles 200 cannot pass through gate arm 18 to enter a controlled area, and to pivot gate arm 18 in a generally vertical, unguarded position such that vehicles 200 are permitted to pass through the gate arm 18 to enter or exit the controlled area.

A mounting post 20 is provided for installing the barrier system 10 adjacent a designated roadway 22, as shown in FIG. 2. Mounting post 20 is securely attached to housing 14 and mounted onto the ground or cement foundation 24 using a metal flange or bracket (not shown). Preferably, the flange includes a set of holes to receive bolts for firmly attaching the flange onto the cement foundation 24. For installation purposes, the height of the mounting post 20 is preselected to align gate arm 18 above the surface of the roadway 22 such that the gate arm 18 spans the width of the roadway 22 to prevent the passage of vehicles 200 when gate arm 18 is displaced horizontally in a guarded position.

Housing 14 is preferably fabricated from a heavy weight sheet metal material or a durable thick plastic material and includes four sidewalls joined to a closed top and bottom. A locked door panel (not shown) may be hingedly attached to one of the four sidewalls to allow service technicians to access control system 16 and related components that are enclosed within the housing 14. Housing 14 is preferably waterproof to withstand the elements of rain and snow, and may include a small transparent window to view status indicators, gages, or other operative elements enclosed within housing 14. In another embodiment, other functional devices (not shown) such as a camera, an intercom, speakers, a phone, or a ticket dispenser, may be secured onto or within housing 14. For example, a camera may be implemented to take photos of license plates of vehicles 200 that pass along the roadway 22 through gate arm 18. Also, an operator may wish to converse with a driver using an intercom or speaker system.

Control system 16 is adapted to pivot gate arm 18 in a horizontal and vertical position to provide a guarded and unguarded position, respectively, to control traffic through roadway 22. Control system 16 may include an electrical control system (not shown) that includes an electric motor coupled to a gearing system such as a gear box, and an electronic DC controller, or variable frequency drive that is used to operate the speed and torque of a DC or AC electric motor. Alternatively, control system 16 may include a pneumatic system (not shown) or hydraulic system (not shown) including an air compressor, a hydraulic pump, fluid motors, pneumatic or hydraulic cylinders, electrical limit switches, valves, filters, couplings, regulators, and hoses or pipes where such components are operatively coupled together to control the pivoting movement of gate arm 18. The operative characteristics of the electric or fluid motors, pumps, compressor or cylinders should be selected to provide the optimum torque and force needed to pivot gate arm 18 in a horizontal and vertical position. An electrical AC power source, via a power cable 28, is provided to power control system 16. Preferably, control system 16 includes a control panel that includes an I/O interface, and may include a keypad or other input keys to program and/or operate functional parameters. A computer system including a processor, memory and interface may also be implemented to operate the vehicle barrier system 10. In yet another embodiment of the present invention, vehicle barrier 10 may include a spring-balanced system with the spring tension holding the security gate arm 18 in an upright, vertical position until pushed downwardly by force. An internal spring counter balancing weight may be included to allow easy lifting and lowering of gate arm 18.

Control system 16 may be operated locally or remotely by an attendant, or may include electronics that provides automated control of gate arm 18 in the absence of an attendant. For example, control system 16 may include an activation device (not shown) such as a camera, motion detectors, or other detectors used to detect or sense the presence of a vehicle 200 or individual and generate a signal to operate gate arm 18. Alternatively, control system 16 may include an electrical switch that comprises a pushbutton, or include an automated ticket dispenser, to permit drivers to operate gate arm 18, via, by manually operating pushbutton, or retrieving a ticket from the ticket dispenser, as often seen at airports.

With continued reference to FIGS. 1 and 2, gate arm 18 comprises an elongated, rigid member having a predefined geometric shape and dimension. In one non-limiting example, gate arm 18 may comprise a square shape, a triangular shape, a rectangular shape, or a circular shape. Gate arm 18 is preferably made of aluminum, a durable heavy duty plastic material, or wood, and may be constructed to include various lengths. In one non-limiting example, gate arm 18 ranges between 3 to 15 feet in length with a preference comprising 12 feet in length. Gate arm 18 may be 3 to 8 inches in diameter and include a wall thickness of Y2 inch. Gate arm 18 may be designed to include a break-away gate where gate arm 18 breaks apart when engaged by a vehicle 200. This feature can be employed to deter damage to both the vehicle barrier system 10 and vehicle 200 in the event the vehicle 200 engages gate arm 18.

Figure 3:
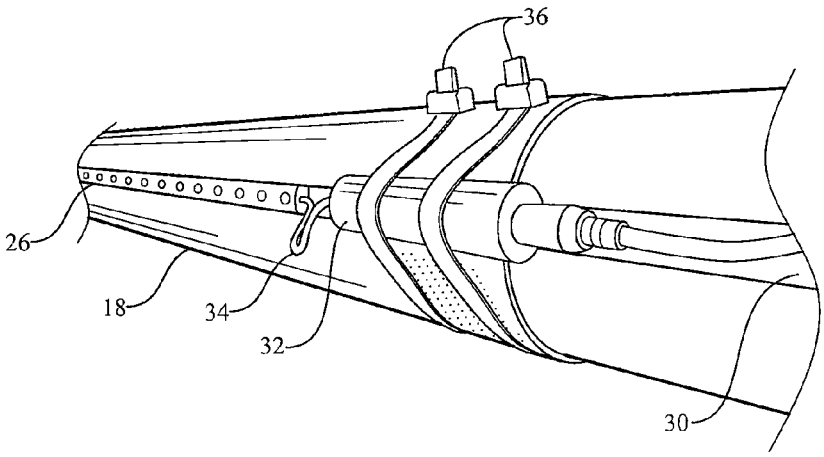
FIG. 3 presents a partial, side perspective view illustrating the array of light emitting diodes removeably secured within an inset channel formed along the longitudinal axis of the gate arm with the array of light emitting diodes electrically connected to an electronic connector that is releasably fastened to the gate arm.

As illustrated in FIGS. 1 through 3, vehicle barrier system 10 includes a light assembly that includes an array of light emitting diodes 26 secured along the length of gate arm 18, in accordance with one embodiment of the present invention. The array of light emitting diodes 26 has the primary function of increasing visibility and alerting drivers to the presence of gate arm 18 at night, or in low lighting conditions. The array of light emitting diodes 26 includes a plurality of light emitting diodes enclosed within a protective enclosure, or alternatively secured within a shock absorbing protective substrate to define a light strip. The protective substrate may comprise any of a transparent rubber, a clear hardened gel material, a clear epoxy, a clear vinyl, or a clear resin material. In the preferred embodiment, each of the plurality of light emitting diodes comprises the same color, however, each of the light emitting diodes may comprise multiple sets of different colors where an N number of light emitting diodes comprise one color, and an N number of light emitting diodes comprise another color. One embodiment may include a high-intensity LED flasher unit. A high-intensity LED flasher unit is capable of outputting a very bright luminescence that IS of considerable increased brightness as compared to standard LED's. The SunBurst Model 1224AD manufactured by Ingram Products of Jacksonville, Fla. operates on either 12V or 24V DC and operates in a flashing mode of 60 flashes per minute, and also draws less-than-half the current as compared to when operating in the steady-on mode.

The array of light emitting diodes 26 includes a plurality of light emitting diodes disposed adjacent each other in series, along the longitudinal axis of gate arm 18. The array of light emitting diodes 26 is removeably secured within inset channel 30 which is formed within the body of gate arm 18, as also illustrated in FIGS. 6 through 9. As illustrated in FIG. 3, the array of light emitting diodes 26 is electrically connected to an electrical connector 32, via, an electrical cable 34. Electrical connector 32 is secured along the outer surface of gate arm 18 via, fasteners 36 that comprise tie wraps in the exemplary embodiment. Tie wraps can be quickly severed to easily and quickly remove the array of light emitting diodes 26 from inset channel 30 for general maintenance, repair or replacement.

Figure 4:
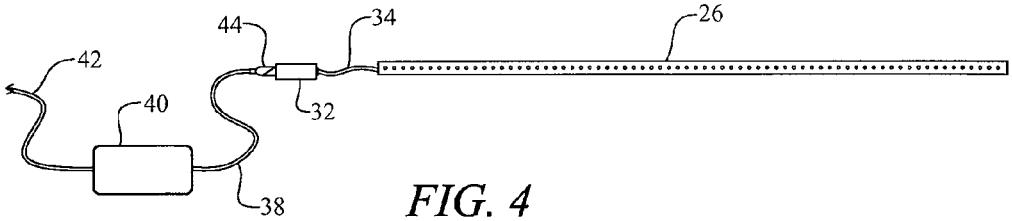
FIG. 4 presents a side view of the light assembly including an array of light emitting diodes release ably connected to an electrical connector that is electrically coupled to a power supply.

With reference now made to FIG. 4, the array of light emitting diodes 26 is electrically connected to electrical connector 32, via electrical cable 34. Electrical connector 32 is electrically, releasably connected to power supply 40, via, electrical cable 38. The power supply 40 may include a step-down transformer and AC to DC converter, a voltage or current regulator, resistors, rectifiers, fuses, a 12 volt battery source, or a 24 volt battery source. Power supply 40 may include a stand-alone DC source, or be electrically coupled to an AC power source via, a power cable 42. A key feature of the present invention is that one end of electrical cable 38 includes an electrical bayonet connector 44 that permits releasable connection to electrical connector 32 for quickly and easily detaching the power supply 40 to the array of light emitting diodes 26. Accordingly, bayonet connector 44 allows a user to quickly and easily disconnect the array of light emitting diodes 26 from the power supply 40 and remove the lights from the inset channel 30 by simply sliding the array of lights out from the inset channel 30.

Figure 5:
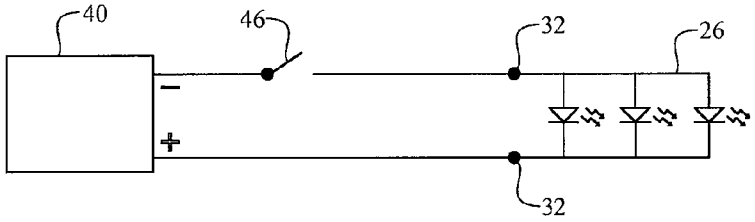
FIG. 5 presents a schematic view of an electrical circuit of the light assembly of FIG. 4, in accordance with one embodiment of the present invention.

The array of light emitting diodes 26 is defined by a plurality of light emitting diodes that are electrically connected together in parallel, as shown in FIG. 5. The electrical parallel connection allows continued operation of light emitting diodes 26 should one or more diodes fail to operate or simply burn out. Power supply 40 is provided to power the array of light emitting diodes 26, via, an electrical switch 46. Preferably, electrical switch 46 is enclosed within housing 14, of the vehicle barrier system 10, and is operated locally or remotely by an attendant. In one alternative embodiment, electrical switch 46 may be operated remotely via, wireless communication, or over an internet interface connection. Electronic switch 46 may include a relay circuit including a transmitter, receiver or transceiver. Where the power supply 40 includes DC batteries, further enhancements to the electrical circuit could include a solar cell array panel (not shown) that is coupled to recharge the power supply 40 during the day.

Figure 6:
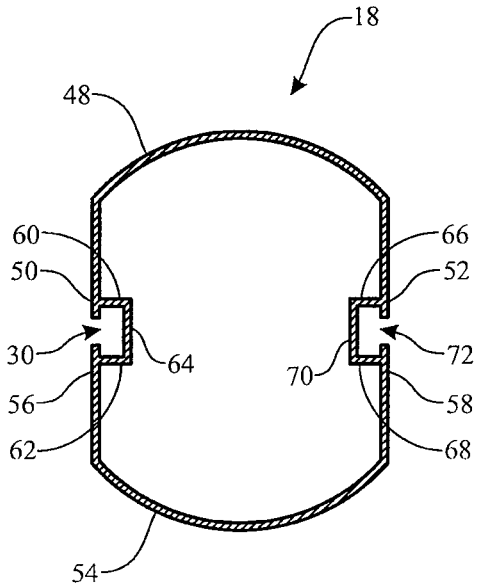
FIG. 6 presents a cross-sectional view of a gate arm including a convex top and a convex bottom, upper and lower sidewalls, and inset channels, each inset channel configured for removeably holding an array of light emitting diodes therein, in accordance with one embodiment of the present invention.

Turning to FIG. 6, there is shown a cross-sectional view of a gate arm 18, in accordance with one embodiment of the present invention. Gate arm 18 includes a convex top member 48 integrally formed to include a first upper sidewall 50, and a second upper sidewall 52. Gate arm 18 also includes a convex bottom member 54 integrally formed to include a first lower sidewall 56 that is aligned coextensively with the first upper sidewall 50, and a second lower sidewall 58 that is aligned coextensively with the second upper sidewall 52. Accordingly, first upper and lower sidewalls 50, 56 and second upper and lower sidewalls 52, 58 form flat sidewalls 50, 52, 56, 58 of gate arm 18. Inset channel sidewalls 60, 62, and inset channel backwall 64 are integrally formed together, along a longitudinal axis within the interior of gate arm 18, to define inset channel 30 having an opening. As depicted in FIG. 6, the first upper and lower sidewalls 50, 56 terminate partially within the opening of inset channel 30. Inset channel sidewalls 66, 68, and inset channel backwall 70 are also integrally formed together, along a longitudinal axis within the interior of gate arm 18, to define inset channel 72 having an opening. The second upper and lower sidewalls 52, 58 terminate partially within the opening of inset channel 72. In the preferred embodiment, inset channel 30 is aligned opposite inset channel 72, though inset channels 30, 72 may be oriented anywhere about gate arm 18. Also, gate arm 18 may include additional inset channels (not shown) to accommodate additional arrays of light emitting diodes 26, if desired. Gate arm 18 may be molded as one unit to include inset channels 30, 72 using well-known injection molding techniques and methods.

Figure 7:
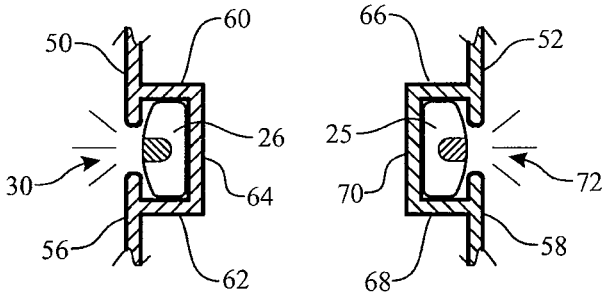
FIG. 7 presents a cross-sectional view illustrating dimensional details of inset channels of FIG. 6, in accordance with one embodiment of the present invention.

A first array of light emitting diodes 26 is inserted within inset channel 30 and cradled within the combination structure of inset channel sidewalls 60, 62, and inset channel backwall 64, as illustrated in FIG. 7. Terminating ends of both the first upper and lower sidewalls 50, 56 help retain the first array of light emitting diodes 26 within the inset channel 30 thus eliminating the need for fasteners and allowing quick and easy removal of the array of light emitting diodes 26 if required. The array of light emitting diodes 26 is positioned within inset channel 30 such that light, enumerated from the light emitting diodes passed through the opening of the inset channel 30 when the light emitting diodes are powered.

A second array of light emitting diodes 25 is also inserted within inset channel 72 and cradled within the combination structure of inset channel sidewalls 66, 68, and inset channel backwall 70, as seen in FIG. 7. Terminating ends of both the second upper and lower sidewalls 52, 58 help retain the array of light emitting diodes 25 within inset channel 72 thus eliminating the need for fasteners and allowing quick and easy removal of the array of light emitting diodes 25 if required. Light emitting diodes 25 enumerate light through the opening of the inset channel 72 when the light emitting diodes 25 are powered. Accordingly, gate arm 18 includes two inset channels 30, 72 for accommodating respective arrays of light emitting diodes 26, 25 on both sides of the gate arm 18 to increase visibility and alert drivers or individuals to the presence of a gate arm 18 when approaching gate arm 18 from either side. This feature proves beneficial where a single vehicle barrier 10 is used to control traffic flow in and out of a designated control access area. In the preferred embodiment, an electrical cable identical to cable 38 also includes an electrical bayonet connector 44 that permits releasable connection to an electrical connector associated with the array of light emitting diodes 25. The bayonet connector 44 provides quick detachment when removing the array of light emitting diodes 25 from inset channel 72. Accordingly, bayonet connector 44 allows a user to quickly and easily disconnect the array of light emitting diodes 25 from the power supply 40 and remove the lights from the inset channel 72 by simply sliding the array of lights out from the inset channel 72.

Figure 8:
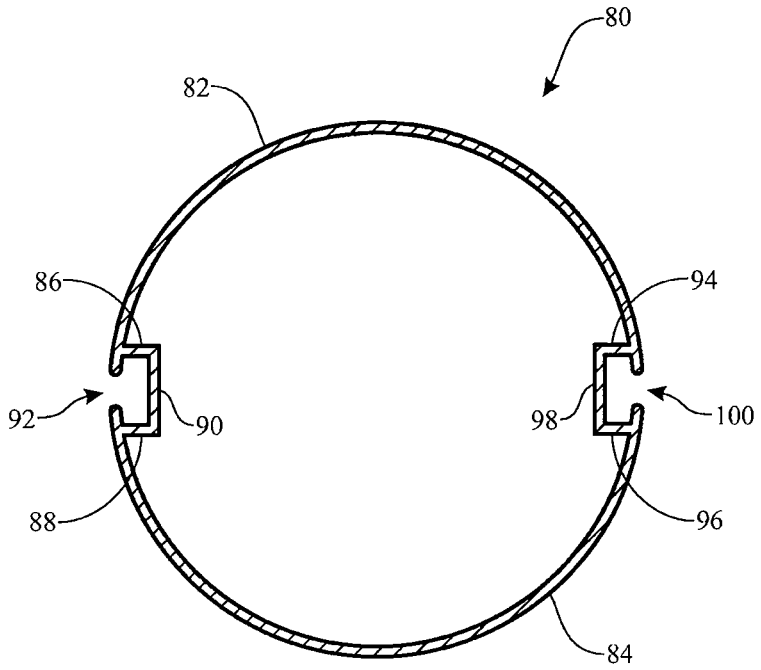
FIG. 8 presents a cross-sectional view of a circular gate arm including inset channels, each inset channel configured for removeably holding an array of light emitting diodes therein, in accordance with another embodiment of the present invention.

Turning to FIG. 8, there is shown a cross-sectional view of a gate arm 80, in accordance with another embodiment of the present invention. In the embodiment, gate arm 80 comprises a circular shape and is preferably constructed from aluminum, a durable heavy duty plastic material, or wood. Gate arm 80 may include various lengths ranging from 3 to 15 feet with a preference comprising 12 feet in length. Gate arm 80 may be 3 to 8 inches in diameter, and include a wall thickness of Y2 inch. Gate arm 80 may be designed to include a break-away gate where gate arm 80 breaks apart when engaged by a vehicle 200. This feature can be employed to deter damage to both the vehicle barrier system 10 and vehicle 200 in the event the vehicle 200 engages gate arm 80.

In a preferred embodiment, gate arm 80 includes a semi-circular shaped first member 82 joined to a semi-circular shaped second member 84, via, inset channels 92 and 100. Inset channel sidewalls 86, 88 and inset channel backwall 90 are integrally formed together, along a longitudinal axis within the interior of gate arm 80, to define inset channel 92 having an opening. Inset channel sidewalls 94, 96 and inset channel backwall 98 are also integrally formed together, along a longitudinal axis within the interior of gate arm 80, to define inset channel 100 having an opening. A first and second end of both members 82, 84 terminate partially within the openings of inset channel 92, and 100 to help retain an array of light emitting diodes within each inset channel 92, 100. Although inset channel 92 is oriented opposite inset channel 100, it will be noted that inset channels 92 and 100 may be oriented anywhere along gate arm 80. Also, gate arm 80 may include additional inset channels (not shown) to accommodate additional arrays of light emitting diodes, if desired.

Figure 9:
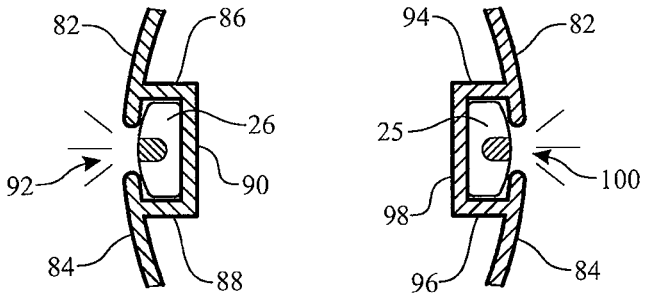
FIG. 9 presents a cross-sectional view illustrating dimensional details of inset channels of FIG. 8, in accordance with another embodiment of the present invention.

As illustrated in FIG. 9, an array of light emitting diodes 26 is inserted within inset channel 92, of gate arm 80, and cradled within the combinational structure of inset channel sidewalls 86, 88, and inset channel backwall 90. A first end of both the first and second member 82, 84, respectively, extends partially within the opening to help retain the array of light emitting diodes 26 within the inset channel 92 thus eliminating the need for fasteners and allowing quick and easy replacement of the array of light emitting diodes 26 for repair or replacement. Light generated from the array of light emitting diodes enumerates through the opening of the inset channel 92. A second array of light emitting diodes 25 is inserted within inset channel 100 and cradled within the combination structure of inset channel sidewalls 94, 96 and inset channel backwall 98, as better illustrated in FIG. 9. A second end of both the first and second member 82, 84 terminates partially within the opening to help retain the array of light emitting diodes 25 within inset channel 100 thus eliminating the need for fasteners and allowing quick and easy removal of the array of light emitting diodes 25 if required. Light emitting diodes enumerate light through the opening of the inset channel 100 when the light emitting diodes 25 are powered. Accordingly, gate arm 80 includes two inset channels 92, 100 for accommodating respective arrays of light emitting diodes 26, 25 on both sides of the gate arm 80 to increase visibility and alert drivers or individuals to the presence of a gate arm 80 when approaching gate arm 80 from either side. The array of light emitting diodes 25 also includes an electrical cable, connector and bayonet connector 44 identical to that of the array of light emitting diodes 26 as shown in FIG. 4.

A lens (not shown) may be provided to help protect the array of light emitting diodes 25, 26 from debris or damage as a result of impact. The lens may comprise a transparent, opaque, tinted, or colored lens, or alternatively include an optical lens providing magnifying, reflective, or light focusing properties. In one non-limiting example, the lens may comprise a Fresnel lens. Preferably each lens comprises an elongated lens that spans the length of each inset channel 30, 72, 92, 100 and may be attached to the gate arm 18, 80 using any bonding agent, or fasteners.

Vehicle barrier system 10 may also include an audible system (not shown) such as an alarm or buzzer that is activated when gate arm 18, 80 is pivoted between horizontal and vertical positions to alert individuals that the gate arm 18, 80 is moving. Vehicle barrier system 10 may also include indicia, media or advertising that is provided anywhere on the housing 14, or gate arm 18, 80.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A vehicle barrier system comprising:

a gate arm formed from a single piece of material that is generally circular shaped having a distal end and a proximal end defining a longitudinal axis therebetween, said proximal end coupled to a housing having a control system and a power supply to selectively pivot said gate arm between a horizontal position and a vertical position, said gate arm including a first elongated inset channel formed along said longitudinal axis of said circular shaped member, said first elongated inset channel having a first opening formed by a first pair of inset channel sidewalls integrally joined to a first channel backwall, said inset channel walls including a first upper terminating end and a first lower terminating end, said ends terminate partially within said first opening and spaced from each other;

a first light strip formed from a plurality of light emitting diodes each electrically connected in parallel and physically disposed adjacent one another in series, and encased within a protective member, said first light strip cradled entirely within said first elongated inset channel between said backwall and said inset channel sidewalls and retained therein solely by said first upper and said first lower terminating ends;

a first electrical cable connected to said plurality of light emitting diodes; and an electronic connector electrically releaseably connected to said power supply and said first electrical cable;

wherein said first light strip is positioned within said first elongated inset channel with said plurality of light emitting diodes aligned towards said first opening such that light from said plurality of light emitting diodes enumerates through said first opening between the terminating ends when said plurality of diodes are powered from said power supply.

2. The vehicle barrier system of claim 1 further comprising a second elongated inset channel formed along said longitudinal axis of said gate arm at a position 180 degrees from said first elongated inset channel, said second elongated inset channel having a second pair of inset channel sidewalls integrally joined to a second inset channel backwall, a second upper terminating end and a second lower terminating end which ends terminate partially within said second opening and spaced from each other, said second elongated inset channel disposed opposite and forming a mirror image of said first elongated inset channel and includes a second removable light strip positioned within said second elongated inset channel with said plurality of light emitting diodes aligned towards said second opening such that light from said plurality of light emitting diodes enumerates through said second opening when said plurality of diodes are powered from said power supply.

3. The vehicle barrier system of claim 1, wherein said light strip is encased within a protective member selected from the group of: a clear rubber material, a clear resin, a clear epoxy, a clear hardened gel, a clear vinyl, or a transparent protective enclosure.

4. The vehicle barrier system of claim 1 including a control system electrically coupled to said first electrical cable to illuminate said first light strip while said barrier is in a horizontal position or a vertical position wherein an N number of light emitting diodes comprise one color and an N number of light emitting diodes comprise another color.

5. The vehicle barrier system of claim 1 wherein said light emitting diodes are coupled to a high-intensity LED flasher unit capable of outputting a luminescence at about 60 flashes per minute.

6. The vehicle barrier system of claim 1 wherein said gate arm is further defined as a circular shaped member formed from a top convex member and a bottom convex member.

7. The vehicle barrier system of claim 1 wherein said single piece of material is aluminum.

8. A method of regulating traffic in a controlled access area, said method comprising the steps of constructing a barrier system comprising:

a housing;

a gate are formed from a single piece of material having a distal end and a proximal end defining a longitudinal axis therebetween, said proximal end coupled to said housing, said gate arm including a first elongated inset channel formed along said longitudinal axis, said first elongated inset channel having a first opening formed by a first pair of inset channel sidewalls integrally joined to a first channel backwall, said inset channel walls including a first upper terminating end and a first lower terminating end, said ends terminate partially within said first opening and spaced apart from each other;

a control system operatively coupled to said gate and including an activation device to selectively pivot said gate arm between a horizontal position and a vertical position;

a first light strip including a plurality of light emitting diodes each electrically connected in parallel and physically disposed adjacent one another in series, and encased within a protective enclosure said first light strip cradled entirely within said first elongated inset channel between said backwall and said inset channel sidewalls and retained therein solely by said first upper and first lower terminating ends;

a control system having an electrical switch selectively operated to couple a power supply to said plurality of light emitting diodes;

wherein said first light strip is removeably retained within said first channel with said plurality of light emitting diodes aligned towards said first opening such that light from said plurality of light emitting diodes enumerates through said first opening between the terminating ends when said plurality of diodes are powered from said power supply;

wherein said first light strip is positioned within said first elongated inset channel with said plurality of light emitting diodes aligned towards said first opening such that light from said plurality of light emitting diodes enumerates through said first opening between the terminating ends when said plurality of diodes are powered from said power supply;

installing said housing and said gate arm near a roadway of said controlled access area;

electrically connecting said power supply to a power source;

activating said electrical switch to power said first light strip; and operating said control system to pivot said gate arm between a horizontal position and a vertical position to selectively control traffic flow in said controlled access area.

9. The method of claim 8, wherein the step of installing said housing and said gate arm near a roadway includes the step of mounting said housing to a mounting post and attaching said mounting post adjacent said roadway.

10. The method of claim 8, wherein the step of operating said control system to pivot said gate arm includes the step of detecting a presence of a vehicle or individual when positioned near said gate and generating a signal to operate said control system.

* * * * *